US007971518B2

(12) United States Patent
Adams

(10) Patent No.: US 7,971,518 B2
(45) **Date of Patent: *Jul. 5, 2011**

(54) DIRECT DRIVE RETROFIT FOR RIFLES

(75) Inventor: Jason Adams, Palm Harbor, FL (US)

(73) Assignee: Adams Arms, Inc., Palm Harbor, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/644,436

(22) Filed: Dec. 22, 2009

(65) Prior Publication Data

US 2010/0101405 A1 Apr. 29, 2010

Related U.S. Application Data

(63) Continuation of application No. 12/218,676, filed on Jul. 17, 2008, now Pat. No. 7,739,939, which is a continuation-in-part of application No. 11/938,678, filed on Nov. 12, 2007, now Pat. No. 7,469,624.

(51) Int. Cl.
*F41A 5/00* (2006.01)

(52) U.S. Cl. ..... 89/191.01; 89/191.02; 89/192; 89/193

(58) Field of Classification Search ..... 89/191.01, 89/191.02, 192, 193, 194
See application file for complete search history.

(56) References Cited

U.S. PATENT DOCUMENTS 2,340,293 A 3/1883 Balleisen
2,484,694 A 10/1949 Dicke
4,085,654 A 4/1978 Panigoni
4,244,273 A 1/1981 Langendorfer, Jr. et al.
4,433,611 A 2/1984 Baumann
4,765,224 A 8/1988 Morris
5,103,714 A 4/1992 LaFrance
5,272,956 A 12/1993 Hudson
5,351,598 A 10/1994 Schuetz
5,520,019 A 5/1996 Schuetz (Continued)

FOREIGN PATENT DOCUMENTS

EP 1 998 134 A2 12/2008

(Continued)

OTHER PUBLICATIONS

"SA-80 Disassembled", SIG Sauer, 1983.

(Continued)

*Primary Examiner* — Michael Carone
*Assistant Examiner* — Daniel J Troy
(74) *Attorney, Agent, or Firm* — Shumaker, Loop & Kendrick, LLP

(57) ABSTRACT

A direct drive retrofit system for use with an M-16 or AR-15 rifle for conversion from an impingement system comprising: a gas block, the gas block having a barrel bore and a gas plug bore; a gas plug, the gas plug being inserted into the gas plug bore from the muzzle end; a bolt carrier key, the bolt carrier key being configured to mount directly to a bolt carrier; a rod, the rod being manufactured from a single continuous material stock; and a biasing means; wherein, the rod can be uninstalled without removal of a hand guard or the gas block by extracting the gas plug from the gas plug bore from the muzzle end, the actuating means releasing the rod, the rod being freely extracted thereafter by a user in a single piece.

31 Claims, 9 Drawing Sheets

U.S. PATENT DOCUMENTS

| | | | | |
|---|---|---|---|---|
| 5,551,179 | A | 9/1996 | Young | |
| 5,634,288 | A | 6/1997 | Martel | |
| 5,824,943 | A | 10/1998 | Guhring et al. | |
| 6,019,024 | A | 2/2000 | Robinson et al. | |
| 6,182,389 | B1 | 2/2001 | Lewis | |
| 6,276,354 | B1 | 8/2001 | Dillon | |
| 6,609,319 | B1 | 8/2003 | Olson | |
| 6,634,274 | B1 | 10/2003 | Herring | |
| 6,775,942 | B2 | 8/2004 | Compton | |
| 6,971,202 | B2 | 10/2005 | Bender | |
| 7,131,228 | B2 | 11/2006 | Hochstrate et al. | |
| 7,316,091 | B1 | 1/2008 | Desomma | |
| 7,418,898 | B1 | 9/2008 | Desommar | |
| 7,448,307 | B1 | 11/2008 | Dafinov | |
| 7,461,581 | B2 | 12/2008 | Leitner-Wise | |
| 7,610,844 | B2 | 11/2009 | Kuczynko et al. | |
| 7,739,939 | B2 * | 6/2010 | Adams | 89/191.01 |
| 7,779,743 | B2 * | 8/2010 | Herring | 89/193 |
| 2005/0262752 | A1 | 12/2005 | Robinson et al. | |
| 2006/0065112 | A1 | 3/2006 | Kuczynko et al. | |
| 2007/0033851 | A1 | 2/2007 | Hochstrate et al. | |
| 2007/0199435 | A1 | 8/2007 | Hochstrate et al. | |
| 2008/0092733 | A1 | 4/2008 | Leitner-Wise et al. | |
| 2009/0031607 | A1 | 2/2009 | Robinson et al. | |
| 2009/0223357 | A1 | 9/2009 | Herring | |

FOREIGN PATENT DOCUMENTS

| | | | |
|---|---|---|---|
| GB | 2 099 965 | A | 12/1982 |
| WO | WO-2006/138106 | A2 | 12/2006 |
| WO | 2008/060310 | A2 | 5/2008 |
| WO | WO-2009/061546 | A2 | 5/2009 |

OTHER PUBLICATIONS

"SIG 550 Disassembled", SIG Sauer, 1983.

"Assault Rilfes SG 550/551 Caliber 5.56 mm (.223) Manual", SAN Swiss Arms AG, date of publication unknown, Neuhausen am Rheinf, Switzerland.

Shea, "British SA80 Rifles The L85A1 and L86A1 LSW", The Small Arms Review, Dec. 2002, vol. 6, No. 3; pp. 61-72.

Raw, "The Last Enfield SA80—The Reluctant Rifle", Collector Grade Publications Inc., 2003; pp. 1, unknown, 21, 44, 66, 114, 120, 221, 285.

"SIG 556 Rifle Components", SIG Sauer, 1983.

"Bushmaster Firearms", Bushmaster Firearms, date of publication unknown.

U.S. Appl. No. 60/772,494, filed Feb. 9, 2006, Hochstrate, et al.

Bushmaster Firearms International, LLC, Windham, Maine USA, "Bushmaster Tech Sheet", Jul. 2006.

Bushmaster Firearms International, LLC, Windham, ME "Supplemental Information to the Bushmaster Operating and Safety Instruction Manual for the Gas Piston . . . ", Aug. 2006.

LWRC International, LLC, Cambridge, MD, "M6 Series Carbines Operator's Manual", 2007-2008.

Department of Defense Access Acknowledgement/Secrecy Order Recommendation for U.S. Appl. No. 60/772,494, filed Apr. 3, 2006.

Order, *Adams Arms, Inc.*, v. *Sig Sauer, Inc.*, Case No. 8:10-CV-146-T-27TGW, Aug. 2, 2010.

* cited by examiner

Gas Exhaust
Gas Inlet

DIRECT DRIVE RETROFIT FOR RIFLES

This is a continuation of U.S. application Ser. No. 12/218,676, filed on Jul. 17, 2008; now U.S. Pat. No. 7,739,939, which is a continuation-in-part of U.S. application Ser. No. 11/938,678, filed on Nov. 12, 2007, now U.S. Pat. No. 7,469,624, each of which is incorporated herein by reference.

BACKGROUND OF THE INVENTION

1. Field of the Invention

This invention relates generally to M-16 and AR-15 rifle-platform firearms having improved direct-drive systems rather than impingement systems; and to retrofit kits which can be used to convert M-16 and AR-15 rifle-platform firearms to direct-drive systems, and the method of using such kits to retrofit M-16 and AR-15 rifle-platform firearms.

2. Description of the Related Art

Replacing the impingement system of the M-16 or AR-15 is not a new idea. Many attempts have been made to do so. It is well known to the gun industry and users of this rifle that it is prone to fouling and jamming due to its design which directs the discharge gas into the bolt carrier to activate the bolt and discharge the spent shell.

The disadvantages of the OEM impingement system are well known and are primarily due to hot, carbon-laden exhaust gases being directed into the bolt carrier and receiver. The heat alone tends to wear parts down, by among other things, exposing this area to thermal cycling. The soot or carbon from the expelled gases, expose the moving parts within the bolt carrier to a hostile environment. The oil needed to keep the area well-lubricated serves to exacerbate the problem by trapping particles and carbon. The combination of factors causes the parts to break, wear, or fail to operate. Failure to operate can be caused by, among other things, fouling and wearing of gas rings and the loosening of ejector and extractor springs. As a result, the spent shell is not ejected properly and the bolt carrier is prevented from traveling properly within the receiver. With extreme fouling and increases in temperature, the spent shell can become entrapped and the gas tube can melt, causing a restriction of flow to the bolt carrier and subsequent failure of operation. Thus, in order to ensure the proper operation of the rifle, it must be cleaned and continually lubricated. Such extra attention is a burden in the field, where reliable, trouble-free operation is essential. With many parts to keep track of consistent cleaning is more difficult in the field.

Others have developed systems to replace the OEM impingement system. Some require that significant portions of the rifle be modified or replaced, such as the barrel and parts within the receiver. However, these systems have significant drawbacks. The cost of replacing the barrel and other parts is substantial. Furthermore, if machining is required to install the system, the user must send the rifle to a machinist to be modified, adding time and expense to the process, and potentially introducing error with each machining process.

Some manufacturers, such as Land Warfare Resources Corporation (LWRC), have designed systems that do not require the replacement of the barrel. The problems with such systems it that in order to clean or inspect the firearm, it is necessary to substantially disassemble a substantial portion of the system in order to access the rod assembly or the gas plug located in the gas block. In some cases, it is necessary to remove the hand guard and loosen the gas block, sliding it muzzleward so that the gas plug can be removed and the rod assembly is free and accessible. Many existing systems also segment the rod into several sections, so that the assembly can be removed from the tight quarters beneath the hand guard. For this reason, a single piece or continuous rod is not possible in such a system. A single rod would not have the necessary clearance for removal.

What is needed and not heretofore provided by the existing art is a M-16 and AR-15 rifle-platform firearm having a direct-drive system which does not require extensive disassembly of the system in order to clean or inspect the fire arm. Further, there is a need for a retrofit kits which can be used to convert M-16 and AR-15 rifle-platform firearms to direct-drive systems. Further needed is a retrofit system not requiring machined modification or replacement of the barrel and other primary parts of the rifle. What is further needed is a retrofit system that is easily assembled and disassembled in the field, having minimal complexity and minimal number of components. What is again needed is a retrofit system that can be removed for inspection and cleaning without substantial disassembly or removal of neighboring parts, such as the gas block or hand guard.

OBJECTS OF THE INVENTION

Accordingly, it is an object of the present invention to provide an M-16 and AR-15 rifle-platform firearm having a direct-drive system and which does not require extensive disassembly of the system in order to clean or inspect the firearm.

It is a further object of the present invention to provide a retrofit system where the gas plug and rod can be removed for inspection and cleaning without substantial disassembly of neighboring parts, such as the gas block or hand guard.

It is a further object of the present invention to provide a retrofit system that is easily assembled and disassembled in the field, by minimizing complexity and the overall number of parts.

It is a further object of the present invention to provide an improved device for the replacement of the OEM rifle impingement system with a direct drive retrofit system.

It is a further object of the present invention to provide a retrofit system that does not require machined modification or replacement of the barrel and other primary parts of the rifle.

These and other objects and advantages of the present invention will become apparent upon reading the following detailed description and upon reference to the accompanying drawings.

SUMMARY OF THE INVENTION

The present invention provides an M-16 and AR-15 rifle-platform firearm having a direct-drive system and which does not require extensive disassembly of the system in order to clean or inspect the firearm. The present invention further provides a new and unique direct drive retrofit system for the M-16 rifle platform, eliminating drawbacks of impingement systems, such as fouling, jamming, and general unreliability in extreme conditions. The present invention also provides a direct drive system that is unique to the existing M-16 modification systems and kits in that it 1) does not require modification to the existing core parts of the rifle, such as the stock, barrel, bolt carrier, and such; and 2) can be easily removed in the field, minimizing the number of individual parts to decrease loss, enabling the removal of the gas plug and connecting rod without the removal of the gas block or hand guard, and, because the rod is a single unit, the rod can be decoupled from the bolt carrier key from the front of the rifle near the gas block and, when installed, transmits energy from expelled gases more effectively to the blot carrier, due to the minimize loss design of the rod. All of these benefits over the existing technologies and more will become evident in the further discussion of the invention as follows.

DESCRIPTION OF THE PREFERRED EMBODIMENTS

Figure 1:
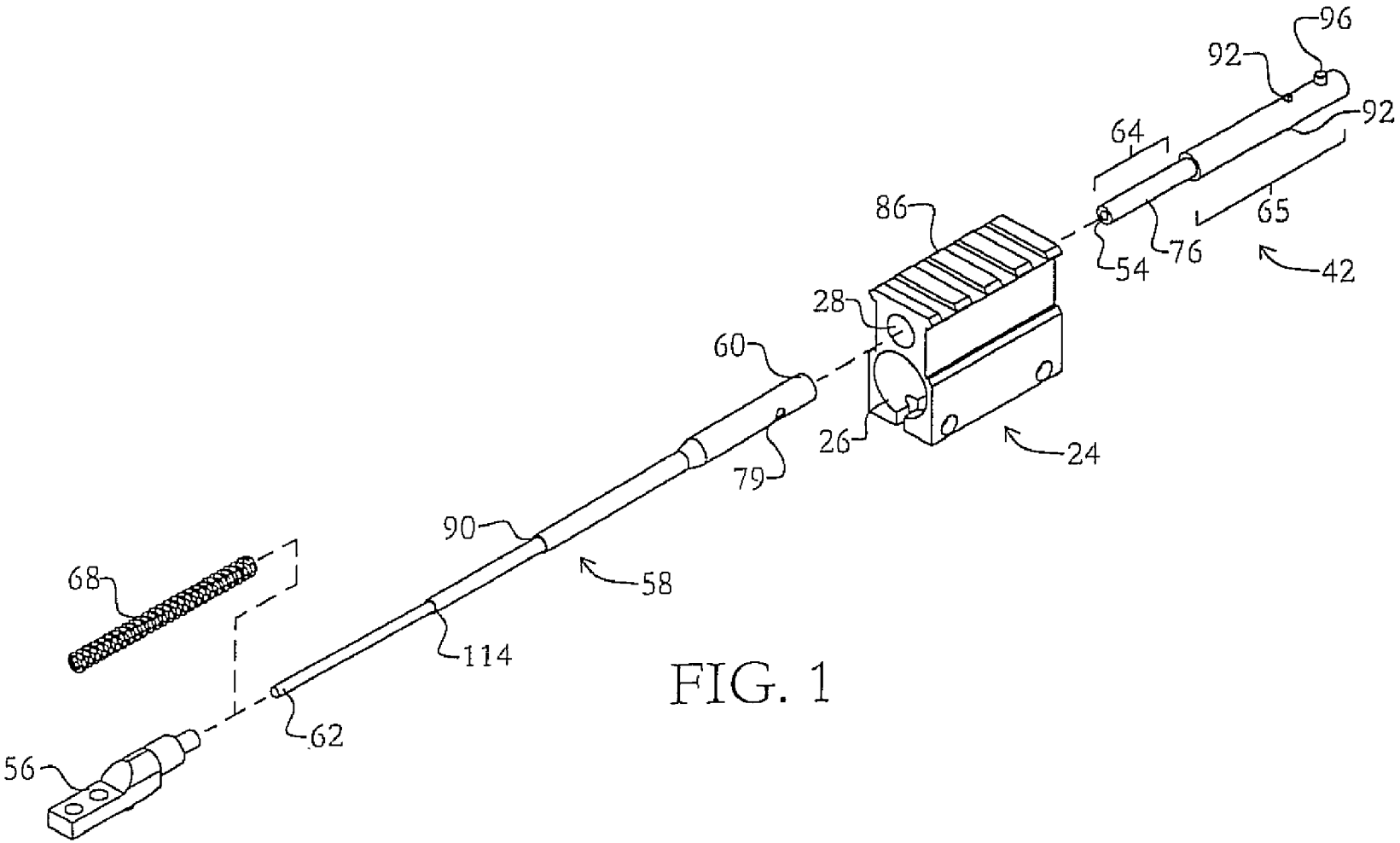
FIG. 1 is an illustration of the direct drive retrofit system (20) of the present invention in exploded perspective.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

A direct drive retrofit system for use with an M-16 or AR-15 rifle for conversion from an impingement system is disclosed comprising: a gas block, the gas block comprising a barrel bore and a gas plug bore, both extending completely through the gas block, the barrel bore and the gas plug bore being substantially parallel one to the other, the barrel bore being configured to receive a barrel securely inserted therein, the barrel bore having an aperture configured to receive a discharge gas from a gas port formed through the barrel proximate to a muzzle of the rifle, the aperture extending from the barrel bore to the gas plug bore, the aperture directing the discharge gas towards the gas plug bore, the gas block being secured to the barrel substantially preventing movement of the gas block relative to the barrel and being configured to hermetically transport the discharge gas from the barrel to the gas plug bore, the gas plug bore having a muzzle end opening towards the muzzle and a breech end opening towards a breech of the rifle; a gas plug; the gas plug insertable into the gas plug bore, preferably from the muzzle end, the gas plug being secured within the gas plug bore by a securing means, an exhaust portion of the gas plug extending out of the breech end of the gas block, the gas plug having a passage being formed internally, the discharge gas being delivered hermetically from the aperture to the passage and towards the exhaust portion; a bolt carrier key, the bolt carrier key being configured to mount directly to a bolt carrier, the bolt carrier moving synchronously with the bolt carrier; a rod, the rod being configured as a single part or a securely connected assembly, the rod extending from the gas plug to the bolt carrier key, a first end of the rod being coupled to the gas plug, a second end being coupled to the bolt carrier key; an actuating means, the actuating means forming an actuation coupling between the gas plug and the rod, the actuating means imparting a kinetic energy of the high pressure of the discharge gas on the rod, the actuating means permitting the rod to be actuated linearly in a breechward direction; a biasing means, the biasing means urging the rod towards the gas plug with an urging force, the biasing means permitting translational movement of the rod when the urging force is exceeded by the actuating means, wherein, upon the firing of a round, the discharge gas under pressure is diverted into the gas port of the barrel, the discharge gas then being transported to the aperture, the discharge gas thereafter being delivered into the passage of the gas plug; and wherein, the discharge gas provides a force to the actuating means, the actuating means causing the breechward motion of the rod translationally; and wherein, the rod thereafter actuates the bolt carrier key causing a breechward translation of the bolt carrier, the breechward translation activating the bolt carrier and an extractor; and wherein, the rod can be uninstalled without removal of a hand guard or the gas block by extracting the gas plug from the gas plug bore from the muzzle end, the actuating means releasing the rod, the rod being freely extracted through the gas plug bore thereafter by a user in a single piece.

As indicated in the background, one of the primary drawbacks of the existing direct drive systems for the M-16 platform is the inability to easily disassemble the system in the field, under extreme conditions. To accommodate this need for easy access for cleaning, repair, and inspection, the present invention has been designed with a unique combination of parts that make disassembly and assembly possible in a quick and easy manner.

The first feature that enables quick access is the gas block and gas plug design. As mentioned, in previous designs, the gas block must be unbolted or loosened from the barrel, to allow the gas block to slide muzzleward, thereby releasing the connection assembly (rods or other direct connectors to the blot carrier) and allowing the removal of the connection assembly. Because the gas block is difficult to align with the original discharge gas aperture in the barrel, removing the gas block gives rise to the time consuming and difficult task of realigning the aperture in the gas block with the gas discharge aperture in the barrel. The present invention's gas block and gas plug design allows the gas plug to be detached and slide forward, towards the muzzle, without affecting the position of the gas block or even loosening it. As the gas plug is slid forward, in the preferred embodiment, it automatically releases a piston-cylinder coupling relationship between it and the rod, the gas plug clearing and completely separating from the gas block, leaving the rod to be pulled out around the gas block or through the gas plug bore that housed the gas plug.

Even the rod is designed for easy access. In some existing systems, the rod is segmented into a plurality of parts so that the rod assembly can be removed without disturbing the gas block. In such systems, it would not be possible to remove the rod in one piece without disturbing the gas block. The disadvantages of segmenting the rod include the fact that there are more small parts to keep track of and potentially lose in the field, and the inherent inefficiencies of transmitting energy through a rod of several parts instead of the continuous rod of the present invention, each joint of the segmentation creating an opportunity for energy loss in its transmission from the gas block to the bolt carrier. The rod of the present invention is of single piece design, preferably machined from a single piece of material; although it is possible to take multiple pieces and bond them in a permanent or semi permanent relationship, creating a secure assembly with welding processes or fastening processes, such that the rod acts and remains intact as one piece.

The rod and bolt carrier key coupling is also important for the easy removal of the rod without removal of the gas bock or hand guard. An example of a convenient biasing means is a compression coil spring, which can be designed such that the rod can be inserted into the compression coil spring which is compressed between the bolt carrier key and an annular shelf formed on an outer circumference of the rod.

In a preferred embodiment, the breechward end of the rod and the bolt carrier key can be configured to rest within a cavity in the bolt carrier key. A coil spring or other biasing means can be used to bias the rod in the direction away from the bolt carrier key and towards the rod/gas plug coupling of the muzzleward end of the rod and the gas plug, the rod being trapped securely between the carrier key and the gas plug when installed. When the rod/gas plug coupling is detached, the rod is free to slide out of the cavity and be pulled from the assembly. Other couplings between the rod and bolt carrier key that permit the removal of the rod without direct access to the bolt carrier key are possible. For example, in an alternate embodiment, the second end of the rod (the breechward end) is flat-faced, contacting a flat face on the bolt carrier key, so that the rod has the capability of pushing the bolt carrier key back abutment.

The direct drive retrofit system comprises an the actuating means comprising a piston-cylinder (rod-sleeve) coupling comprising: a piston (i.e., the exhaust or breechward portion of the gas plug, the exhaust portion being generally cylindrical in shape; an exhaust outlet, the exhaust outlet being formed at a terminus of the exhaust portion, the exhaust outlet permitting the expelling of the discharge gas; a sleeve, the sleeve being formed by the first end of the rod, the first end being generally cylindrically hollow in shape forming the sleeve, the breechward portion of the gas plug being configured to nest within a hollow portion of the sleeve, and having a smaller diameter than the cylinder inner diameter, a gap being formed therebetween; wherein, upon the firing of the round, the discharge gas under pressure is expelled from the exhaust outlet, the discharge gas imparting the force into the sleeve, the sleeve resultantly translating breechward thus causing the breechward motion of the rod; and wherein the discharge gas is released to atmosphere through the gap.

The rod preferably has a cup shaped sleeve formed on the muzzleward end; the sleeve is configured to receive the end of the gas plug, the gas plug acting as a piston. The gas plug has a passage to allow the discharge gas to flow from the barrel breechward to the piston portion of the gas plug, exiting the exhaust outlet on the terminus of the piston. The exhaust gas impacts the cylinder, pushing the rod breechward. After pushing the rod, the discharge gas exits the system through the gap formed between the inner diameter of the cylinder and outer diameter of the piston. It is possible, although not the best mode, to arrange the gas plug as a cylinder and the end of the rod as a piston, effectively reversing the arrangement from the preferred mode.

In one embodiment, the carrier key is attached to the bolt carrier by a dowel which is inserted through the hole (FIG. 5) (106) which hereto fore received the combustion gases when the firearm was outfitted with an impingement system. In another embodiment particularly well suited to the gas plug/sleeve rod assembly of the present invention, a metal dowel is press-fitted to the carrier key, and the carrier key is then attached to the bolt carrier through the residual hole which is a holdover from the impingement system. It has been found that with the present inventive system, the press-fitted embodiment is surprisingly superior to the embodiment in which the dowel is attached to the carrier key via other methods. In a further embodiment, the carrier key and dowel are integral.

The rod and sleeve of the present invention are among the many differences between the present invention and the impingement systems and other systems known in the art, including retrofit systems that have been used to impart motion to the bolt. It has been found that when a rod and sleeve system is used, the carrier key can be fabricated such that it does not include a sleeve-like receptacle for the rod. Unexpectedly, such a system functions well without the use of the sleeve thought to be necessary in other piston-type systems. In fact early tests of the system indicate that not only is a sleeve unnecessary, but it actually impedes the function of the inventive system in that it breaks free of the key. Thus in a preferred embodiment, the rod strikes the carrier key in a flat surface.

Furthermore, when the sleeve component which is part of the gas plug/sleeve assembly is not provided with combustion gas escape holes (FIG. 3) (79), a surprising result obtains: no visible combustion flash is detected upon firing. This is an advantage because during night time operations, it is often necessary to use night-vision goggles, the function of which is impaired by bright flashes. The lack of a combustion flash is unexpected in that the exit of combustion gases still takes place. In the inventive apparatus, the combustion gases exit the system via clearance between the rod and the sleeve.

It should be noted that while the rod and sleeve arrangement has been referred to herein as a "piston"-type system, it is not a true piston system as referred to in many pieces of art. A true piston system, as illustrated by many systems in the art, is a system in which a sealed volume (a piston and a cylinder) is forced to enlarge due to an increase in gas amount or volume. In order to get the greatest amount of work from the piston, the cavity formed by the piston and the cylinder must expand hermetically, and the piston slides within the cylinder to accommodate the increase in volume needed.

Figures 2, 3, 4:
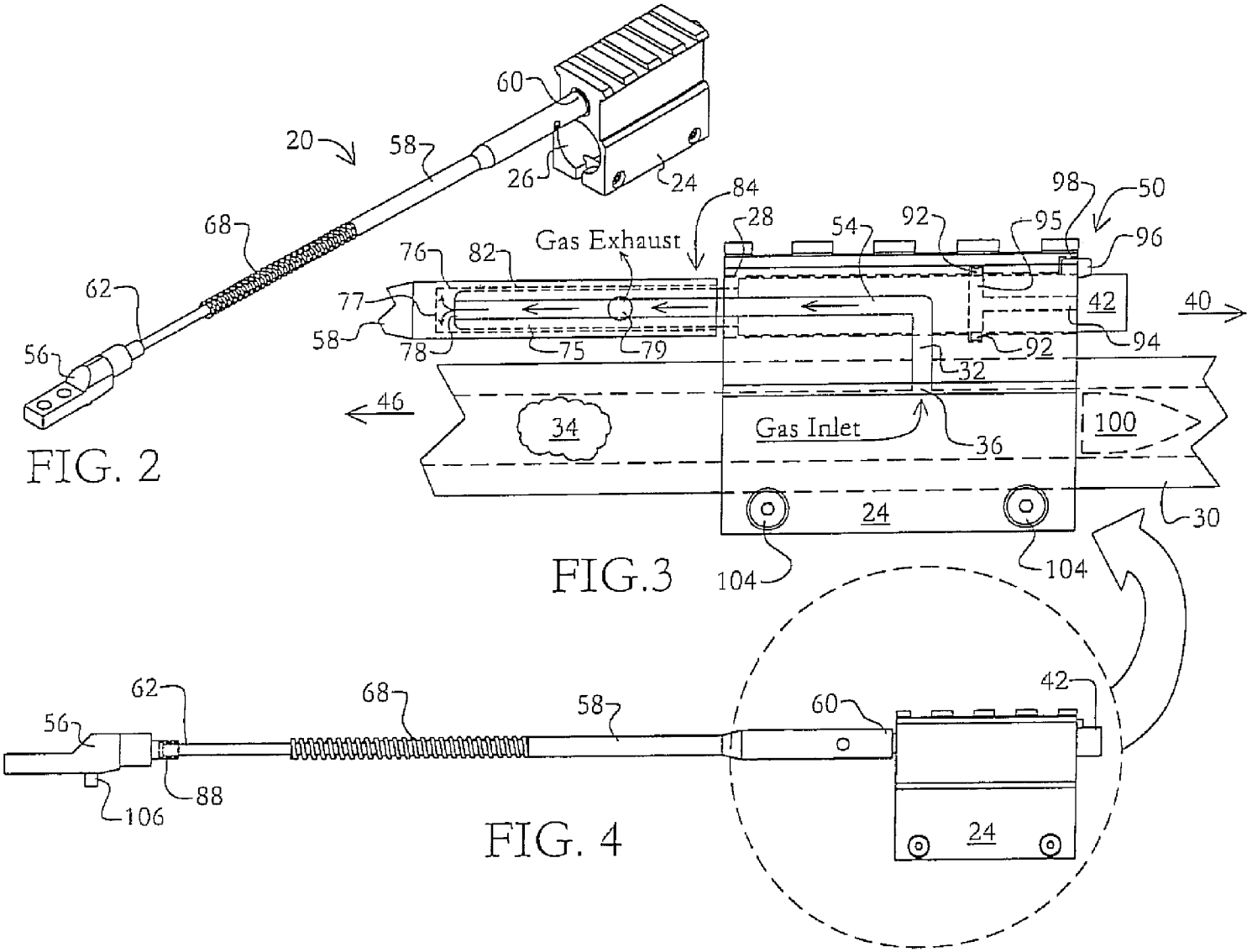
FIG. 2 is an illustration of the direct drive retrofit system (20) of the present invention in perspective.
FIG. 3 is a magnified illustration of the direct drive retrofit system (20) of the present invention with internal details shown in phantom.
FIG. 4 is an illustration of the direct drive retrofit system (20) of the present invention in profile.

The rod and sleeve is not a piston system in the sense used in the art. The requirement for greater volume is met not by the increase in size of a sealed cavity, but by the sliding of the sleeve away from a fixed gas plug, with gases having the ability to escape between the inner diameter of the sleeve (82) and the outer diameter of the gas plug (FIG. 3). Such a system leads, in many cases unexpectedly, to the advantages given herein (for example, no combustion flash and no requirement for a sleeve portion on the carrier key for the rod to reside in). Thus, while the systems of the present application may both loosely be referred to as piston systems, as is done in some cases below, major physical differences separate the present invention from the systems typically referred to as "piston systems" in the art.

Figure 7:
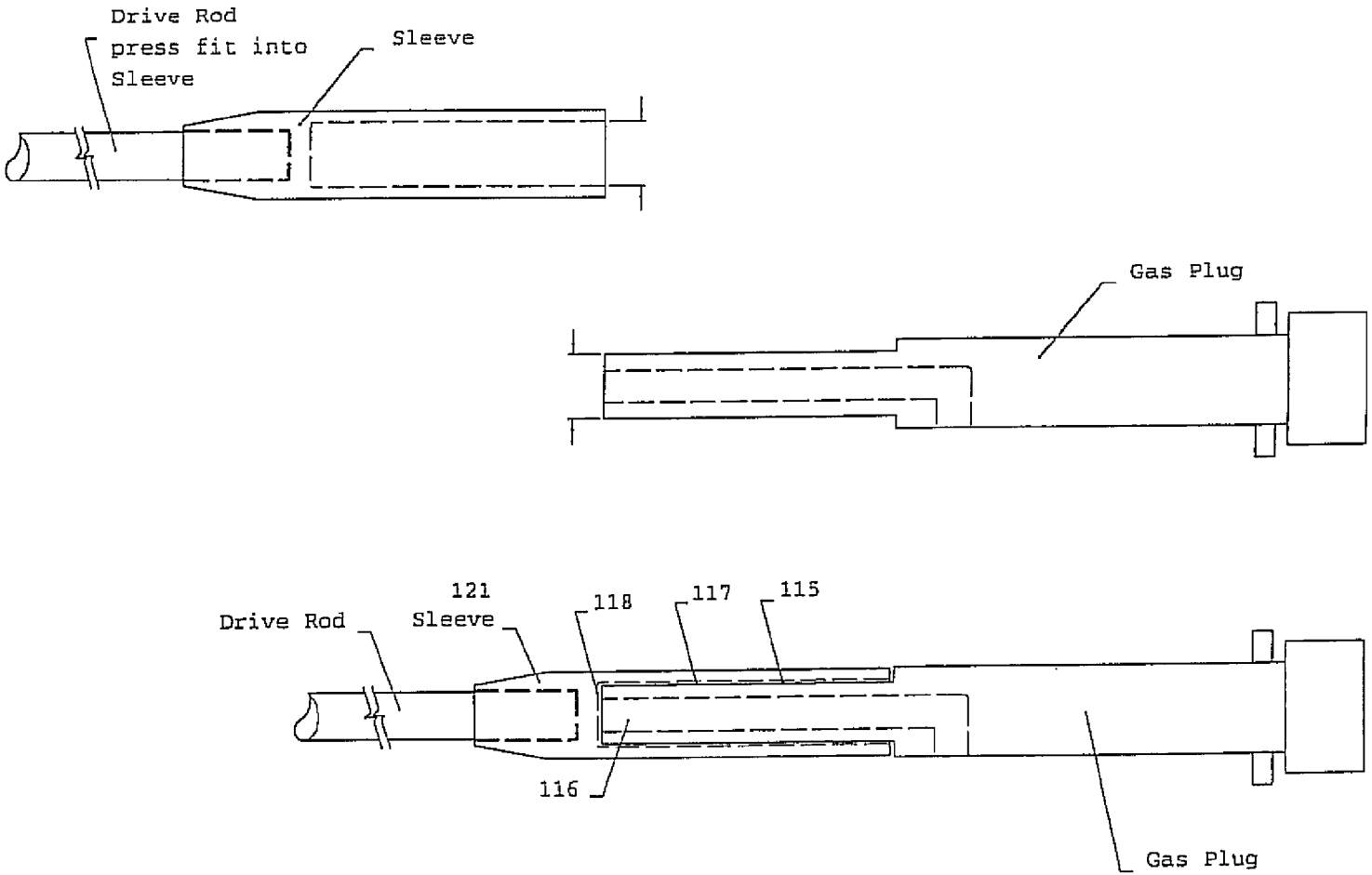
FIG. 7 is an illustration of the rod/sleeve/gas plug assembly.

While the invention in its broadest aspect encompasses a gas plug/sleeve rod assembly which is used to transfer mechanical energy to the carrier pin in order to initiate bolt carrier action, some dimensions of the sleeve rod/gas plug/gas block assembly can be important to the proper functioning of the assembly. For example, the tolerance between the outer diameter of the gas plug and the sleeve into which it fits (FIG. 7) (115) should be in the range of from about 0.00025" to about 0.0020" thousandths of an inch. More preferably the tolerance is in the range of from about 0.0009" to about 0.0017" thousandths of an inch. The inner diameter (116) of the portion of the gas plug which fits into the sleeve is preferably in the range of from about 0.080" to 0.170", and more preferably in the range of from about 0.120" to about 0.130". The outer diameter (117) of the above portion is in the range of from about 0.3000" to about 0.3500", and more preferably from about 0.3126" to about 0.3130". Again, the preferred sleeve gas plug tolerance is noted above. It is preferred that the end of the gas plug nestle securely against the inner portion of the beginning portion of the sleeve (118).

In a preferred embodiment, one or more of the rod, sleeve, and hollow rod/gas plug are coated with melanite.

To enable the mounting of a scope or other equipment the gas block can be designed with a Picatinny rail formed thereon.

The direct drive retrofit system wherein the securing means further comprises: at least one key, the key being formed on an outer surface of the gas plug; a keyway, the keyway being formed within the gas plug bore, the keyway being configured to receive the key; a detent, the detent having a spring loaded ball, the detent being located on the gas plug, a depression being located in a corresponding position within the gas plug bore; wherein the key is aligned with the keyway, the gas plug is inserted into the gas plug bore, the spring loaded ball nesting within the depression.

Because the gas plug undergoes extreme stresses in the course of firing a round, it is important to firmly secure the gas block to the barrel and the gas plug to the barrel. The gas block is secured to the barrel in a pipe clamp type arrangement with two screws providing compression to clamp the block to the barrel.

It is possible to have one key or a plurality of keys formed on the gas block; preferably there are two opposing keys. There are, therefore, two corresponding keyways formed in the gas plug bore of the gas block. The keys prevent substantial rotation of the gas plug relative to the gas block, allowing for the consistent and accurate alignment of the internal passage of the gas plug to the gas port of the rifle barrel, either directly or through the gas block. The detent prevents substantial linear movement of the gas plug along its axis when secured into a corresponding hole or depression in the gas block. A hole formed through the gas plug bore to the external wall of the gas block would provide a stop for the detent and allow user access to the detent to depress it during the removal process. It is also possible to form a crook in the keyway to provide further axial security.

In a separate embodiment, the novel configuration of the rod, gas plug and gas block enables the system to be performance optimized for many variables which affect the operation of the bolt carrier and the resulting ejection of the spent cartridge. One issue which has arisen with retrofit kits, and even with firearms which are old, worn, damaged or otherwise not properly operating is the failure of the bolt action to be in proper synchronization with the ejection of the cartridge. When the system is funning too "fast," the cartridges are ejected at the 2 o'clock position or earlier, relative to the muzzle. When the gun is running too "slow," the cartridges are ejected at the 4 o'clock position or later, relative to the muzzle. Thus, a meter of a properly synchronized system is the ejection of cartridges at roughly the 3 o'clock position. However, the degree and timing of the bolt action is dictated by the action of the combustion gas as it expands into the barrel, through the connecting aperture (FIG. 8) (119) into the gas plug (120), ultimately pushing the sleeved rod (FIG. 7) (121), and thus the carrier key/carrier assembly (FIG. 1)(56), breechward. Many variables, such as barrel rifling, bullet weight, gun wear, gun damage or other variables which affect the speed at which the combustion gases enter the gas plug, affect the impulse of the rod on the carrier key. It should be noted that some of the above synchronization issues can arise in guns having an impingement system.

Figure 9:
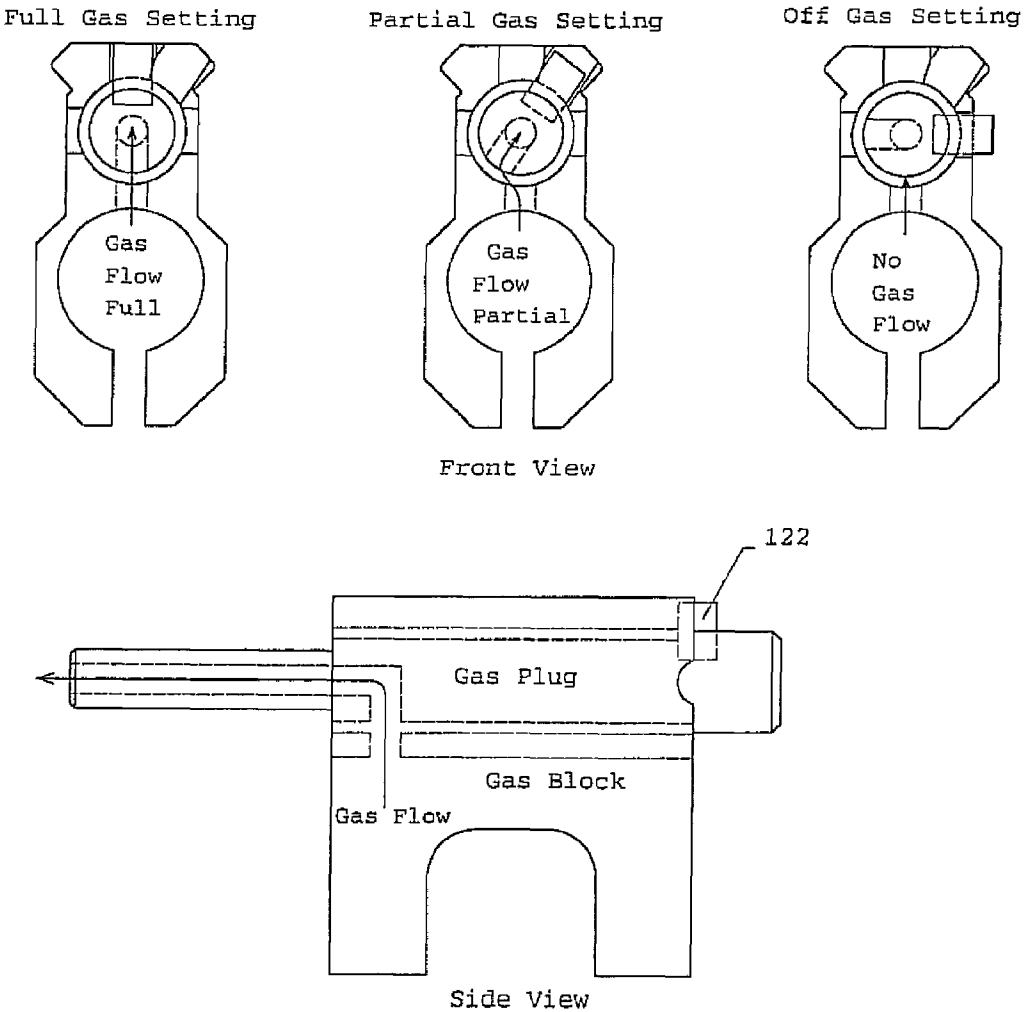
FIG. 9 is an illustration of the partial gas embodiment.
Figure 10:
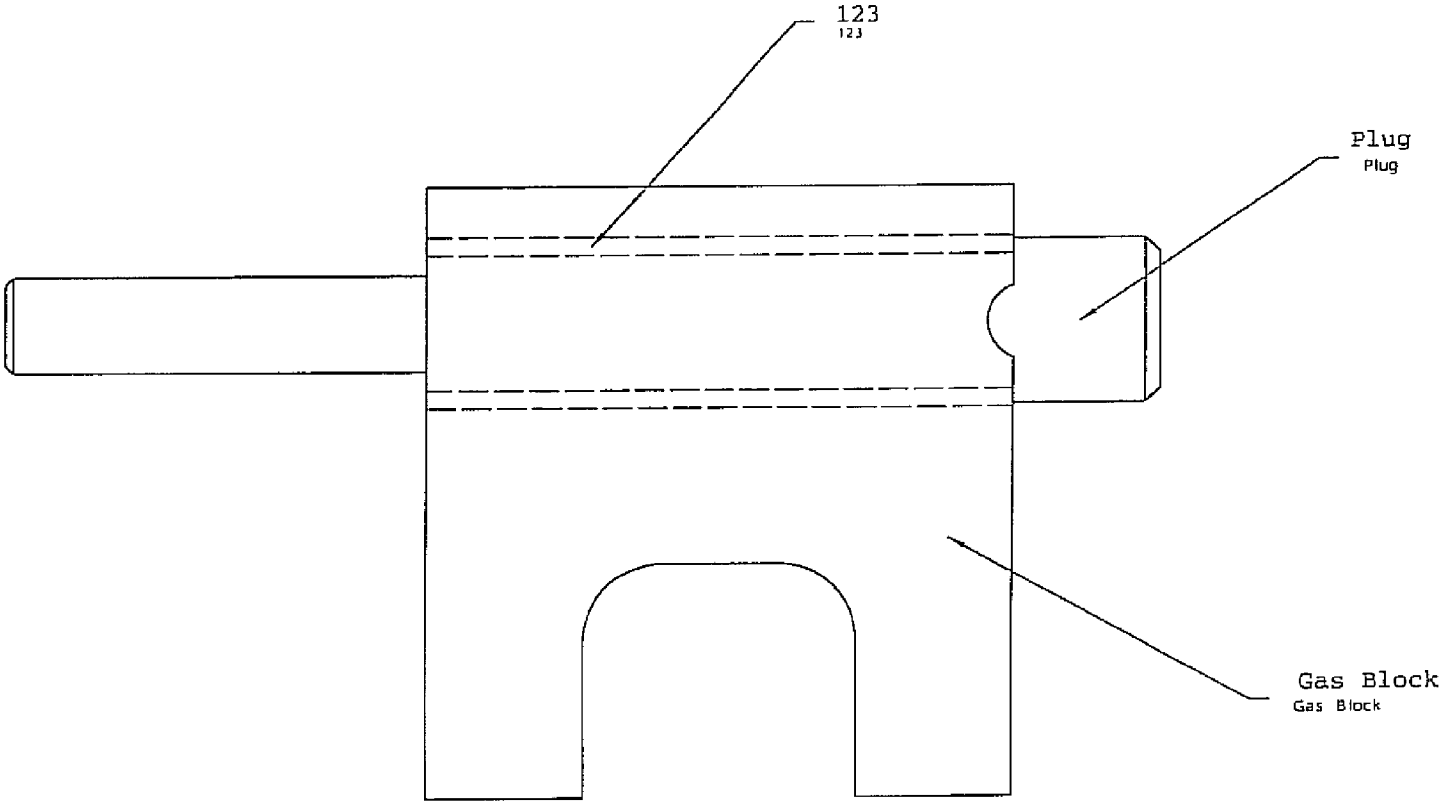
FIG. 10 is an illustration of the gas block/gas plug assembly.

With the present invention, synchronization issues can be eliminated due to the presence of a gas plug component. The gas plug is ordinarily in direct alignment with the aperture connecting the two bores in the gas block. However, the presence of a gas plug component which can rotated inside the gas block allows the operator to "unalign" the gas plug by rotating it to a degree inside the gas block. Such a rotation allows "partial gas" operation, and can be used to "tune" the synchronization until the desired ejection (i.e., around the 3 o'clock position) is achieved. Thus, in one embodiment, the present invention comprises a gas plug which can be locked into any one of a continuous range of alignment positions with respect to the gas block. In another embodiment, the present invention comprises a gas plug/gas block assembly which can be locked into one of one or more discrete positions. (FIG. 9). Locking mechanisms include détente buttons (FIG. 9)(122) located in the gas block, or loosenable screws threaded into the gas block which can immobilize the gas plug at a given degree of rotation. If desired, the gas plug can contain discrete depressions on its surface to accept the tip of the immobilizing screw, thereby allowing the operator to set the gas at preset positions. In one embodiment, the gas plug is rotated such that it does not align with the gas block aperture. In this setting, the system is off.

It is preferred that the tolerance between the gas plug and the gas block be such that the gas plug can be easily slid into the gas block, and rotated, if necessary for the partial gas embodiment. However, too great a tolerance can give "blowback," in which the expanding gases escape between the gas plug and the gas block, rather than travel through the gas block aperture into the gas plug. Thus it is preferable that the tolerance between the outer diameter of the gas plug and the inner diameter of the gas block be in the range of from about 0.0001" to about 0.005", and more preferably in the range of from about 0.0002" to about 0.001".

Figure 8:
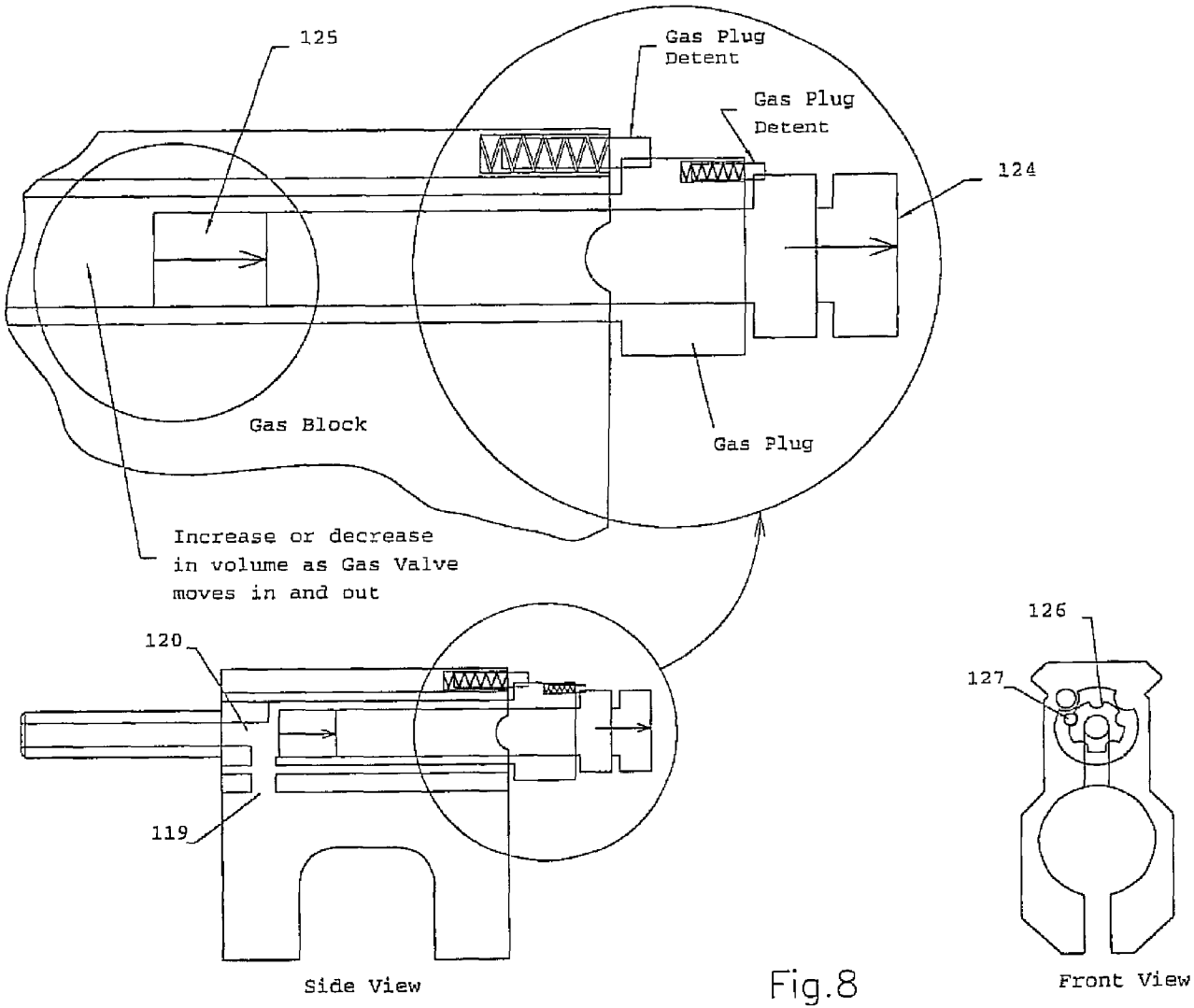
FIG. 8 is an illustration of the infinite gas embodiment.

In yet another embodiment, the "gas" can be adjusted using yet a different modification of the gas plug. For example, the volume of the gas plug can be conveniently adjusted by a screw which is configured to screw (FIG. 8) (124) into the muzzleward end of the gas plug. Upon advancing the screw into or out of the gas plug, the volume (125) contained by the gas plug and the inner end of the sleeve is reduced or increased, respectively. The impulse and timing of the rod upon the carrier key can be adjusted, thereby giving the operator yet another means to adjust the synchronization of the firearm. In one embodiment, the head of the screw comprises a fluted edge (FIG. 8) (126) and is rotated next to a détente button in the gas plug (FIG. 8). The détente button (127), when raised, prevents further turning of the screw by occupying one of the flutes. The front view in FIG. 8 is an illustration of a screw with five flutes. In yet another embodiment, the screw is locked in place by a screw threaded radially through the side of the gas plug, most conveniently at the portion of the gas plug which extends from the muzzleward end of the gas block. Once the volume adjusting screw in the muzzleward end of the gas plug has been turned to the desired volume adjustment, the radial screw can be tightened to immobilize the volume adjusting screw.

With the above two embodiments for the adjustment of synchronization, the individual and simultaneous affects of a multitude of variables, both mentioned above and not, on synchronization can be compensated. Thus, in one embodiment of the present invention, a method is provided for synchronizing a gun having an impingement system or a piston system and a cartridge eject in a direction greater than about 4 o'clock or less than about 2 o'clock, said method comprising retrofitting the gun with the retrofit system of the present invention comprising a partial gas or infinite gas-type gas plug; and adjusting the gas plug, either by orientation within the gas block, or via an end screw, such that spent cartridges are ejected at a roughly 3 o'clock position relative to the muzzle.

Figure 11:
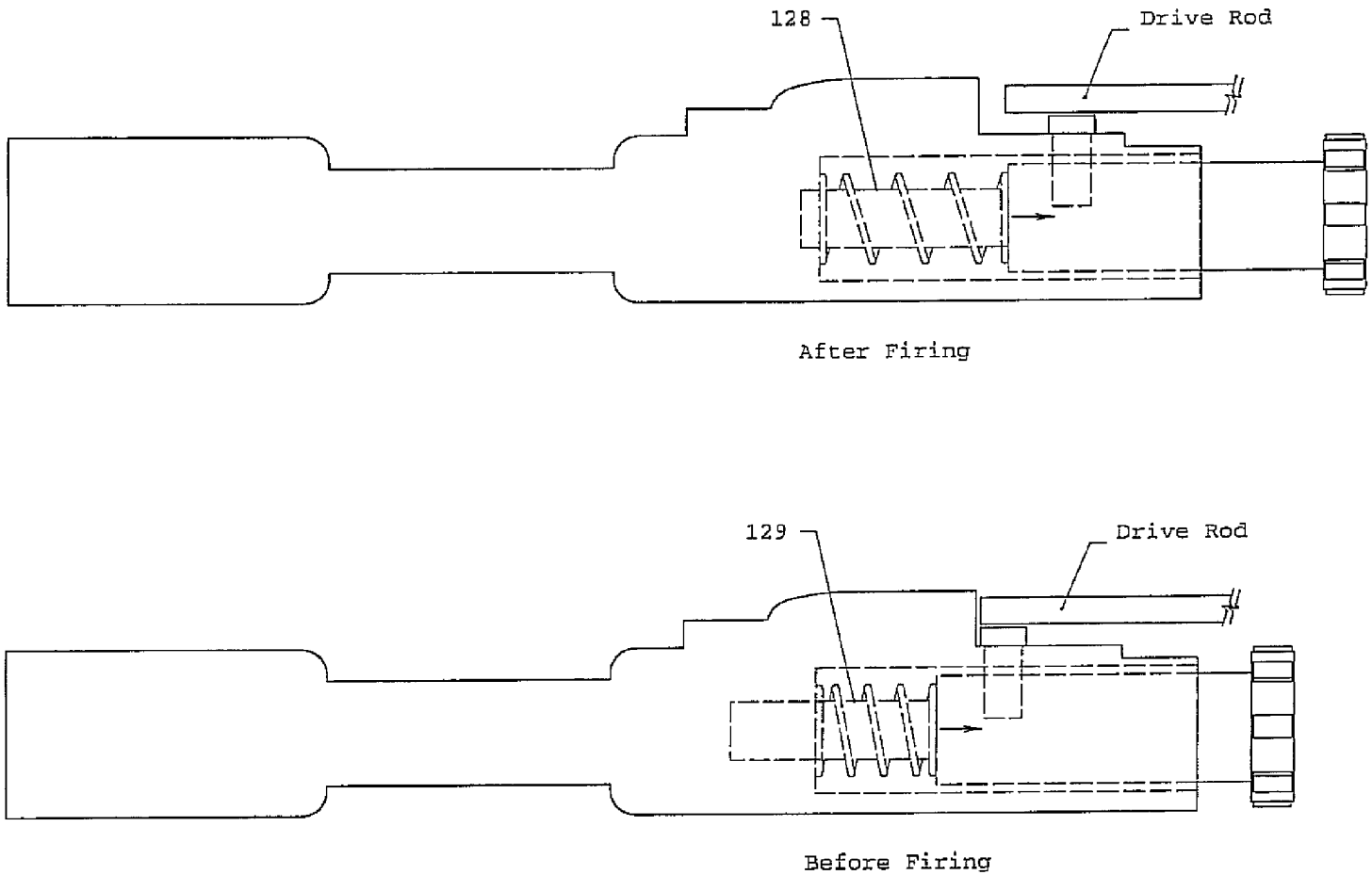
FIG. 11 is an illustration of the compression spring-bearing bolt embodiment.

In yet another embodiment of the present invention, a special bolt (FIG. 11) (128) is used. As a replacement for the gas ring-bearing bolt which is part of nearly all impingement systems, but which can be left in upon retrofitting with the inventive system described herein, the retrofit kit can additionally comprises a compression spring (129)-bearing bolt which is devoid of gas rings. Such a bolt can be fabricated by mechanically turning the gas rings down to the axis of the bolt.

Such a bolt is particularly appropriate for use with the inventive system of the present invention. It has been found through extensive testing that one minor issue with the system of the present invention is that after firing, the bolt remains in a position which is less than fully forward. Not only does this give make necessary a temporary "breaking in period" when using the system, it also can result in gases entering the bolt chamber during times when a silencer or suppressor is used with the gun (it is recommended that the indirect gas system be disengaged when using a silencer, and carbon-laden combustion fumes can be directed back into the bolt chamber). In order to minimize the entry of the combustion gases, a compression spring-loaded bolt is used such that the bolt is biased to the front of the chamber after firing.

As mentioned, an important aspect of the present invention is the ability to remove the gas plug and rod without removing the hand guard or moving the gas block forward. The unique combination of parts make this possible; and also require a unique method of assembly and disassembly. The initial installation of the system is more involved, requiring replacement of the OEM gas block, OEM hand guard, OEM bolt carrier key, OEM hand guard bracket, and removal of the gas line. Once the new gas block and bolt carrier key has been installed, it is often only required to remove just the rod and gas plug to access parts for cleaning and inspection. Higher levels of disassembly are possible by removing the new hand guard and new hand guard bracket; and the highest level of disassembly would require the removal of the gas block. However, under most field circumstances it is only necessary to remove the rod and gas plug.

A method for removing a direct drive retrofit system for an M-16 or AR-15 rifle consisting of a gas block, a gas plug, a rod, a piston-cylinder coupling, and a bolt carrier key without removal of a hand guard or the gas block comprising the steps: extracting the gas plug from the gas block in a muzzleward direction; decoupling the piston-cylinder coupling formed between the gas plug and the rod, a piston formed on the gas plug being slid out of a cylinder being formed on the rod upon extraction; removing the rod in a singular piece, the rod being free to be lifted away from the gas block, the rod being decoupled from the blot carrier key without requiring access to the bolt carrier key.

A method for installing a direct drive retrofit system for an M-16 or AR-15 rifle consisting of a gas block, a gas plug, a rod, a piston-cylinder coupling, and a bolt carrier key without removal of a hand guard or the gas block comprising the steps: inserting the rod in a singular piece through the hand guard, the rod being coupled to the blot carrier key without requiring access to the bolt carrier key; inserting the gas plug into a gas plug bore from the muzzleward direction towards the breech; coupling a cylinder being formed on the gas plug to a cylinder being formed on the rod, the piston being nested within the cylinder forming a piston-cylinder coupling; securing the gas plug within the gas plug bore.

An exemplary embodiment of the present invention is shown in FIGS. 1-6. Looking first at FIG. 1, the direct drive retrofit system (20) is shown in an exploded view, with dashed lines indicating the assembly configuration. The primary parts of the present invention comprise a gas plug (42), a gas block (24), a rod (58), a coil spring (68), and a bolt carrier key (56). Looking at the gas block (24), there are two bores formed through the body, the gas plug bore (28) and the barrel bore (26). The gas plug bore (28) is configured to receive the gas plug (42); and the barrel bore (26) is configured to receive a barrel (30) of a rifle (22). On the top portion of the gas block (24) a Picatinny rail (86) is formed for receiving mounted equipment, such as a scope (not shown). The rod (58) is configured to couple with the gas plug (42) at a first end (60) and the bolt carrier key (56) at a second end (62). The second end (62) of the rod (58) is inserted into the coil spring (68), one end of the coil spring resting on the annular shelf (90). Looking at the gas plug (42), there is an exhaust portion (64) with a passage (54) formed therethrough. There are two keys (92) and a depressible detent (96) formed on the main body (65) of the gas plug (42).

Turning to FIGS. 2 and 4, the primary parts of the present invention are shown in an assembled state, without showing the rifle (22), to clearly show how these parts are connected in the assembled direct drive retrofit system (20). In FIG. 4, the second end (62) of the rod (58) is inserted into a cavity (88) formed in the bolt carrier key (56), in a slip fit relationship.

Looking at FIG. 3, a close-up view of the gas block (24), barrel (30), gas plug (42), and the first end (60) of the rod (58), showing the details of the piston-cylinder coupling (84) and how the discharge gas (34) actuates the coupling, also showing the details of the securing means (50) holding the gas plug (42) within the gas plug bore (28) of the gas block (24). The gas block (26) is securely fastened to the barrel (30) by tightening screws (104). Although, other fastening arrangements are possible, the screws (104) are preferred for effectiveness and simplicity.

Focusing first on the path of the discharge gas (34), a round (100) is fired in the rifle (22) traveling in the muzzleward direction (40) being propelled by the discharge gas (34). When the round (100) passes the gas port (36) formed through the barrel (30), a portion of the discharge gas (34) is directed therein. The discharge gas (34) fluidly communicates with the passage (54) in the gas plug (42) via the aperture (32) formed in the gas block (24), leading from the barrel bore (26) to the gas plug bore (28). The discharge gas (34) travels in the breechward direction (46) through the passage (54) from the main body (65) to the exhaust portion (64), exiting the gas plug (42) into the piston-cylinder coupling (84) formed between the rod (58) and the gas plug (42), a bore in the rod (58) forming the cylinder (76) and the exhaust portion (64) of the gas plug (42) forming the piston (75).

Upon exiting the passage (54), the discharge gas (34) impinges on the bottom (77) of the cylinder (76). The pressure of the discharge gas (34) exerts a force against the bottom (77) of the cylinder (76), pushing the rod (58) in the breechward direction (46). After imparting a breechward translation on the rod (58), the discharge gas (34) is directed through a gap (82) between the piston (75) and the cylinder (76), finally exiting to atmosphere through the exhaust outlet (79). Upon the depressurization of the piston-cylinder coupling (84), the spring (68) urges the rod (58) back in the muzzleward direction (40). The rod (58) is normally biased in the muzzleward direction (40) when no pressure is present in the piston-cylinder coupling (84). Upon the resetting of the piston-cylinder coupling (84), the direct drive retrofit system (20) is prepared to receive the discharge gas (34) of the following round (100).

Looking more particularly at the securing means (50), upon insertion of the gas plug (42) into the gas plug bore (28) both keys (92) are aligned with their respective linear keyways (94). The linear keyways (94) terminate at an annular keyway (95), being formed over the diameter of the gas plug bore (28). The gas plug (42) is pushed straight back in the breechward direction (46), following the linear keyways (94). One linear keyway (94) is sufficiently large to partially receive the detent (96) which is aligned with one of the keys (92). In one embodiment, linear keyways (94) are formed at the 0 degree and the 180 degree marks. The keyway (94) at the 180 degree mark is sufficiently sized to partially receive the detent (96) when the detent is depressed. The gas plug (42) is then rotated to the 90 degree mark, to the detent notch (98), the keys (92) simultaneously rotating within the annular keyway (95). Upon reaching the detent notch (98) the detent is released and partially resides within the detent notch (98). The detent (96) prevents rotation of the gas plug (42) while the keys (92) within the annular keyway (95) prevent the movement of the gas plug (42) in or out of the gas plug bore (28).

Figure 5:
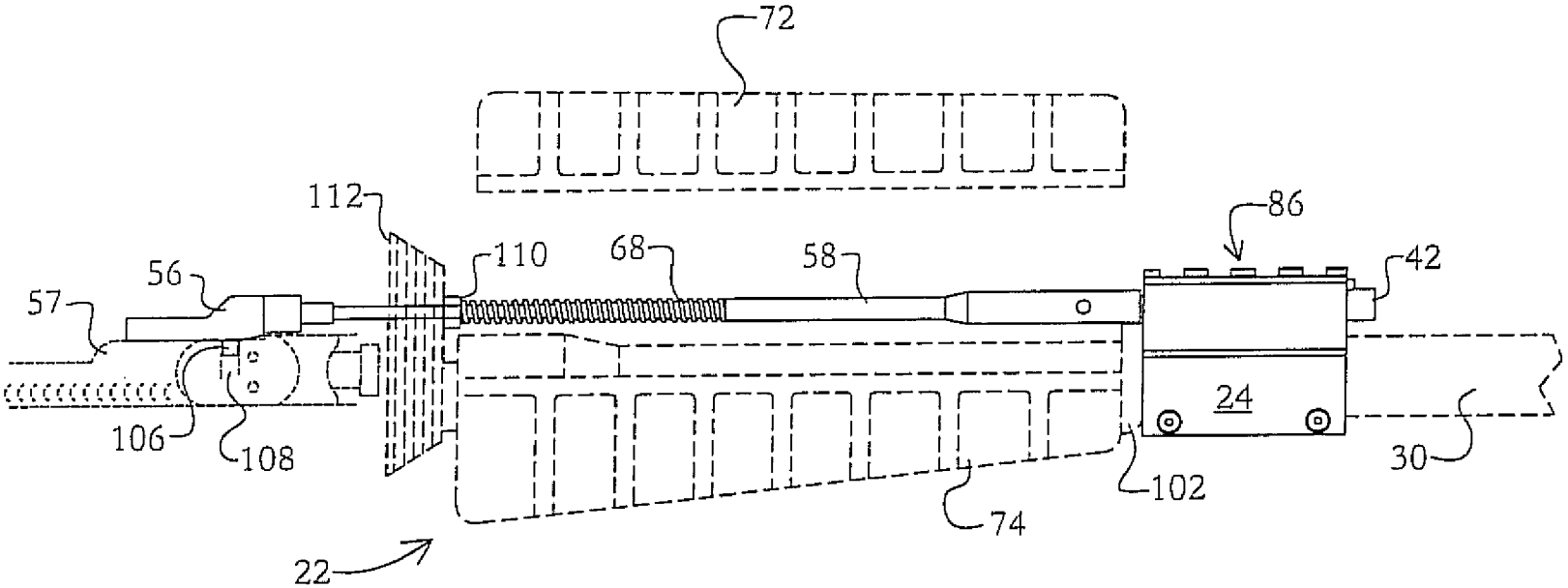
FIG. 5 is an illustration of the direct drive retrofit system (20) of the present invention in profile, installed on a rifle.

Looking now at FIG. 5, the direct drive retrofit system (20) is shown installed in an exemplary rifle (22), shown in phantom. The gas block (24) is fastened to the barrel (30), screws (104) tighten the barrel bore (26) around the barrel (30). The upper hand guard (72) and the hand guard bracket (102) are modified providing clearance to allow the rod (58) to freely translate. The lower hand guard (74) is fastened beneath the rifle (22). The coil spring (68) is partially compressed between the delta ring (112) and the annular shelf (90) of the rod (58). The second end (62) of the rod (58) nests within the cavity (88) of the bolt carrier key (56). The bolt carrier key (56) is mounted on the bolt carrier (57), the dowel protrusion (106) inserted into the OEM gas passage (108). Optionally, a bushing (110) is shown, acting as a spacer to provide the correct spring force and also as a block to limit the breechward travel of the rod (58), the stop (114) of the rod (58) impacting the bushing (110), therefore stopping the travel. An added benefit of the bushing (110) and stop (114) is that it prevents the rod (58) from being dislodged from the gas plug (42) in the event of a spring (68) failure.

As the rod (58) translates in the breechward direction (46) the spring (68) is compressed and the bolt carrier key (56) is also translated in the breechward direction (46), pushing the bolt carrier (57) similarly back. The breechward translation of the bolt carrier (57) serves to extract the casing of the spent round, thereafter chambering the next live round, the process being repeated for the duration of the firing occurrence.

As stated previously, the most important advantage of this invention when compared to existing retrofit systems is the ability to easily disassemble and assemble the gas plug (42) and the rod (58) of the direct drive retrofit system (20) without the removal of the gas block (24), the upper hand guard (72), the lower hand guard (74), or the hand guard bracket (102). It is necessary, on occasion, to have the ability to easily access the parts of the rifle (22) that are exposed to the fouling discharge gas (34) for cleaning and service. The gas plug (42), the rod (58), and the gas plug bore (28) are all exposed to the discharge gas (34) to a degree, and therefore, require cleaning.

Figure 6:
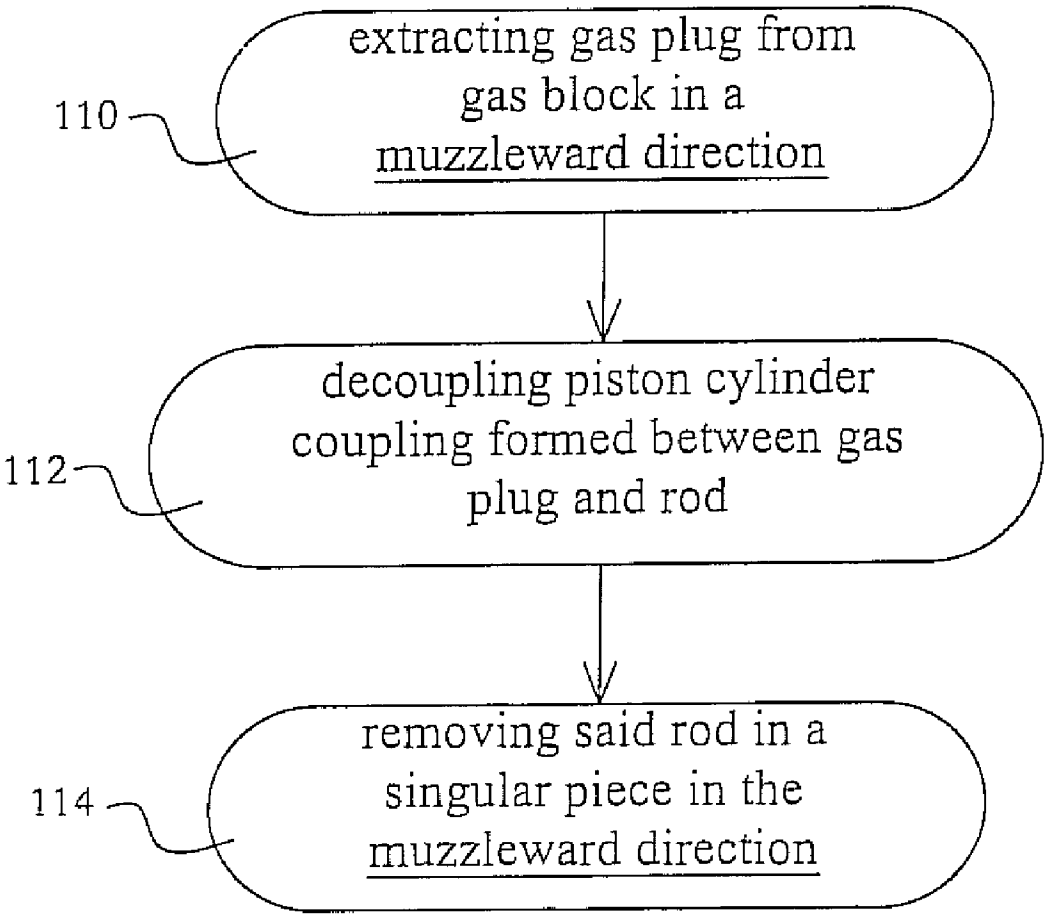
FIG. 6 is a diagram describing the disassembly of the direct drive retrofit system (20) of the present invention.

The method of disassembly is shown in the flowchart of FIG. 6. To start, the gas plug (42) is extracted from the gas block (24) in the muzzleward direction (40), (step 110). The piston-cylinder coupling (84) is decoupled (step 112), allowing the gas plug (42) to be fully removed from the gas plug bore (28). The rod (58) can then be removed as a single piece in the muzzleward direction (40), through the gas plug bore (28), (step 114).

While the present invention has been described with regards to particular embodiments, it is recognized that additional variations of the present invention may be devised without departing from the inventive concept.

I claim:

1. A system for use with a rifle, said system comprising:

a gas block, said gas block having a barrel bore and a gas plug bore, both extending completely through said gas block, said barrel bore and said gas plug bore being substantially parallel one to the other, said barrel bore being configured to receive a barrel securely inserted therein, said barrel bore having an aperture being configured to receive a discharge gas from a gas port formed through said barrel proximate to a muzzle of said rifle, said aperture extending from said barrel bore to said gas plug bore, said aperture directing said discharge gas towards said gas plug bore, said gas block being secured to said barrel substantially preventing movement of said gas block relative to said barrel and being configured to transport said discharge gas from said barrel to said gas plug bore, said gas plug bore having a muzzle end opening towards said muzzle and a breech end opening towards a breech of said rifle;

a gas plug, said gas plug being secured within said gas plug bore by a securing means, an exhaust portion of the gas plug having a breechward orientation; said gas plug having a passage being formed internally, said discharge gas passing from said aperture to said passage and towards said exhaust portion;

a bolt carrier key, said bolt carrier key being configured to move synchronously with a bolt carrier;

a rod, said rod being configured as a single part or a securely connected assembly, a first end of said rod being coupled to said gas plug, a second end being coupled to said bolt carrier key;

an actuating means, said actuating means forming an actuation coupling between said gas plug and said rod, said actuating means imparting a kinetic energy of the high pressure said discharge gas on said rod, said actuating means permitting said rod to be actuated linearly in a breechward direction; said actuating means comprising:

a hollow rod, said hollow rod being formed by said exhaust portion of said gas plug;

an exhaust outlet, said exhaust outlet being formed at a terminus of said exhaust portion, said exhaust outlet permitting the expelling of said discharge gas;

a sleeve, said sleeve being formed by said first end of said rod, said first end being generally hollow forming said sleeve, said hollow rod being configured to nest within the hollow portion of said sleeve, a gap being formed therebetween;

wherein, upon the firing of a round, said discharge gas under pressure is expelled from said exhaust outlet, said discharge gas imparting said force into said sleeve by impingement of said gas on said sleeve, said sleeve resultantly translating breechward thus causing a breechward motion of said rod;

and wherein said discharge gas is released to the atmosphere through an exhaust port via said gap;

a biasing means, said biasing means urging said rod towards said gas plug with an urging force, said biasing means permitting translational movement of said rod when said urging force is exceeded by said actuating means;

wherein, upon the firing of a round, said discharge gas under pressure is diverted into said gas port of said barrel, said discharge gas then being transported to said aperture, said discharge gas thereafter being delivered into said passage of said gas plug;

and wherein, said discharge gas provides a force to the actuating means, said actuating means causing said breechward motion of said rod translationally;

and wherein, said rod thereafter actuates said bolt carrier key causing a breechward translation of said bolt carrier, said breechward translation activating said bolt carrier and an extractor; and wherein said rod can be uninstalled without removal of a hand guard or said gas block by extracting said gas plug from said gas plug bore from said muzzle end, said rod being extractable through said gas plug bore thereafter by a user in a single piece upon extraction of said gas plug.

2. The system of claim 1 further comprising a gas block and gas plug capable of variable gas settings.

3. The system of claim 2 wherein the gas plug can be rotated to a continuous range of settings.

4. The system of claim 2 wherein the gas plug can be rotated to discrete settings within in the gas block.

5. The system of claim 4 wherein the discrete settings are secured by a detente pin.

6. A system for use with a rifle, said system comprising:

a gas block, said gas block having a barrel bore and a gas plug bore, both extending completely through said gas block, said barrel bore and said gas plug bore being substantially parallel one to the other, said barrel bore being configured to receive a barrel securely inserted therein, said barrel bore having an aperture being configured to receive a discharge gas from a gas port formed through said barrel proximate to a muzzle of said rifle, said aperture extending from said barrel bore to said gas plug bore, said aperture directing said discharge gas towards said gas plug bore, said gas block being secured to said barrel substantially preventing movement of said gas block relative to said barrel and being configured to transport said discharge gas from said barrel to said gas plug bore, said gas plug bore having a muzzle end opening towards said muzzle and a breech end opening towards a breech of said rifle;

a gas plug, said gas plug being secured within said gas plug bore by a securing means, an exhaust portion of the gas plug having a breechward orientation, said gas plug having a passage being formed internally, said discharge gas passing from said aperture to said passage and towards said exhaust portion;

a bolt carrier key, said bolt carrier key being integral with a bolt carrier;

a rod, said rod being configured as a single part or a securely connected assembly, a first end of said rod being coupled to said gas plug, a second end being coupled to said bolt carrier key;

an actuating means, said actuating means forming an actuation coupling between said gas plug and said rod, said actuating means imparting a kinetic energy of the high pressure said discharge gas on said rod, said actuating means permitting said rod to be actuated linearly in a breechward direction;

said actuating means comprising:

a hollow rod, said hollow rod being formed by said exhaust portion of said gas plug;

an exhaust outlet, said exhaust outlet being formed at a terminus of said exhaust portion, said exhaust outlet permitting the expelling of said discharge gas;

a sleeve, said sleeve being formed by said first end of said rod, said first end being generally hollow forming said sleeve, said hollow rod being configured to nest within the hollow portion of said sleeve, a gap being formed therebetween;

wherein, upon the firing of a round, said discharge gas under pressure is expelled from said exhaust outlet, said discharge gas imparting said force into said sleeve by impingement of said gas on said sleeve, said sleeve resultantly translating breechward thus causing a breechward motion of said rod;

and wherein said discharge gas is released to the atmosphere through an exhaust port via said gap;

a biasing means, said biasing means urging said rod towards said gas plug with an urging force, said biasing means permitting translational movement of said rod when said urging force is exceeded by said actuating means;

wherein, upon the firing of a round, said discharge gas under pressure is diverted into said gas port of said barrel, said discharge gas then being transported to said aperture, said discharge gas thereafter being delivered into said passage of said gas plug;

and wherein, said discharge gas provides a force to the actuating means, said actuating means causing said breechward motion of said rod translationally;

and wherein, said rod thereafter actuates said bolt carrier key causing a breechward translation of said bolt carrier, said breechward translation activating said bolt carrier and an extractor; and wherein, said rod can be uninstalled without removal of a hand guard or said gas block by extracting said gas plug from the gas plug bore from said muzzle end, said rod being extractable through said gas plug bore thereafter by a user in a single piece upon extraction of said gas plug.

7. A system for use with a rifle, said system comprising:

a gas block, said gas block having a barrel bore and a gas plug bore, both extending completely through said gas block, said barrel bore and said gas plug bore being substantially parallel one to the other, said barrel bore being configured to receive a barrel securely inserted therein, said barrel bore having an aperture being configured to receive a discharge gas from a gas port formed through said barrel proximate to a muzzle of said rifle, said aperture extending from said barrel bore to said gas plug bore, said aperture directing said discharge gas towards said gas plug bore, said gas block being secured to said barrel substantially preventing movement of said gas block relative to said barrel and being configured to transport said discharge gas from said barrel to said gas plug bore, said gas plug bore having a muzzle end opening towards said muzzle and a breech end opening towards a breech of said rifle;

a gas plug, said gas plug being secured within said gas plug bore by a securing means, an exhaust portion of the gas plug having a breechward orientation, said gas plug having a passage being formed internally, said discharge gas passing from said aperture to said passage and towards said exhaust portion;

a rod, said rod being configured as a single part or a securely connected assembly, a first end of said rod being coupled to said gas plug, a second end capable of being coupled to said bolt carrier key;

an actuating means, said actuating means forming an actuation coupling between said gas plug and said rod, said actuating means imparting a kinetic energy of the high pressure said discharge gas on said rod, said actuating means permitting said rod to be actuated linearly in a breechward direction, said actuating means comprising:

a hollow rod, said hollow rod being formed by said exhaust portion of said gas plug;

an exhaust outlet, said exhaust outlet being formed at a terminus of said exhaust portion, said exhaust outlet permitting the expelling of said discharge gas;

a sleeve, said sleeve being formed by said first end of said rod, said first end being generally hollow forming said sleeve, said hollow rod being configured to nest within the hollow portion of said sleeve, a gap being formed therebetween;

wherein, upon the firing of a round, said discharge gas under pressure is expelled from said exhaust outlet, said discharge gas imparting said force into said sleeve by impingement of said gas on said sleeve, said sleeve resultantly translating breechward thus causing a breechward motion of said rod;

and wherein said discharge gas is released to atmosphere through and exhaust port via said gap;

a biasing means, said biasing means urging said rod towards said gas plug with an urging force, said biasing means permitting translational movement of said rod when said urging force is exceeded by said actuating means;

wherein, upon the firing of a round, said discharge gas under pressure is diverted into said gas port of said barrel, said discharge gas then being transported to said aperture, said discharge gas thereafter being delivered into said passage of said gas plug;

and wherein, said discharge gas provides a force to the actuating means, said actuating means causing said breechward motion of said rod translationally;

and wherein, said rod thereafter actuates said bolt carrier key causing a breechward translation of said bolt carrier, said breechward translation activating said bolt carrier and an extractor;

and wherein, said rod can be uninstalled without removal of a hand guard or said gas block by extracting said gas plug from said gas plug bore from said muzzle end, said rod being extractable through said gas plug bore thereafter by a user in a single piece upon extraction of said gas plug.

8. The system of claim 7 wherein the gas plug comprises an end screw by which the volume of the gas plug can be changed.

9. The system of claim 7 wherein said bolt carrier key has a dowel press fitted thereto, said dowel being configured to seat within an existing hole on said bolt carrier.

10. The system of claim 7 wherein said sleeve is machined or formed directly in said rod.

11. The system of claim 7 wherein said biasing means is a compression coil spring, said rod being inserted into said compression coil spring, said coil spring being compressed between a delta ring and an annular shelf formed on an outer circumference of said rod.

12. The system of claim 7 wherein said direct drive retrofit system can be installed on said rifle without modification of said barrel and said bolt carrier.

13. The system of claim 7 wherein said gas block has a Picatinny rail formed thereon.

14. The system of claim 7 wherein said bolt carrier key has a dowel protrusion machined thereon, said dowel protrusion being configured to seat within an existing hole formed on said bolt carrier.

15. The system of claim 7 further comprising a compression-spring-loaded bolt which does not bear gas rings.

16. The system of claim 7 wherein said securing means comprises:

at least one key, said key being formed on an outer surface of said gas plug;

a keyway, said keyway being formed within said gas plug bore, said keyway being configured to receive said key;

a detent, said detent being spring loaded, said detent being located on said gas plug, a detent notch being located in a corresponding position within said gas plug bore;

wherein said key is aligned with said keyway, said gas plug is inserted into said gas plug bore, said spring loaded ball nesting at least partially within said detent notch.

17. A firearm comprising:

a gas block, said gas block having a barrel bore and a gas plug bore, both extending completely through said gas block, said barrel bore and said gas plug bore being substantially parallel one to the other, said barrel bore in receipt of a barrel securely therein, said barrel bore having an aperture configured to receive a discharge gas from a gas port formed through said barrel proximate to the muzzle of said rifle, said aperture extending from said barrel bore to said gas plug bore, said aperture directing said discharge gas towards said gas plug bore, said gas block being secured to said barrel substantially preventing movement of said gas block relative to said barrel and being configured to transport said discharge gas from said barrel to said gas plug bore, said gas plug bore having a muzzle end opening towards said muzzle and a breech end opening towards a breech of said rifle;

a gas plug, said gas plug being secured within said gas plug bore by a securing means, an exhaust portion of the gas plug having a breechward orientation, said gas plug having a passage being formed internally, said discharge gas passing from said aperture to said passage and towards said exhaust portion;

a bolt carrier key, said bolt carrier key being integral with said bolt carrier, and moving synchronously with said bolt carrier;

a rod, said rod being configured as a single part or a securely connected assembly, said rod extending from said gas plug to said bolt carrier key a first end of said rod being coupled to said gas plug, a second end being coupled to said bolt carrier key;

an actuating means, said actuating means forming an actuation coupling between said gas plug and said rod, said actuating means imparting a kinetic energy of the high pressure said discharge gas on said rod, said actuating means permitting said rod to be actuated linearly in a breechward direction; said actuating means comprising:

a hollow rod, said hollow rod being formed by said exhaust portion of said gas plug, an exhaust outlet, said exhaust outlet being formed at a terminus of said exhaust portion, said exhaust outlet permitting the expelling of said discharge gas;

a sleeve, said sleeve being formed by said first end of said rod, said first end being generally hollow forming said sleeve, said hollow rod being configured to nest within a hollow portion of said sleeve, a gap being formed therebetween;

wherein, upon the firing of a round, said discharge gas under pressure is expelled from said exhaust outlet, said discharge gas imparting said force into said sleeve by impingement of said gas on said sleeve, said sleeve resultantly translating breechward thus causing a breechward motion of said rod;

and wherein said discharge gas is released to the atmosphere through an exhaust port via said gap;

a biasing means, said biasing means urging said rod towards said gas plug with an urging force, said biasing means permitting translational movement of said rod when said urging force is exceeded by said actuating means;

wherein, upon the firing of a round, said discharge gas under pressure is diverted into said gas port of said barrel, said discharge gas then being transported to said aperture, said discharge gas thereafter being delivered into said passage of said gas plug;

and wherein, said discharge gas provides a force to the actuating means, said actuating means causing said breechward motion of said rod translationally;

and wherein, said rod thereafter actuates said bolt carrier key causing a breechward translation of said bolt carrier, said breechward translation activating said bolt carrier and an extractor;

and wherein, said rod can be uninstalled without removal of a hand guard or said gas block by extracting said gas plug from the gas plug bore from said muzzle end said rod being extractable through said gas plug bore thereafter by a user in a single piece upon extraction of said gas plug.

18. The firearm of claim 17 wherein the gas plug comprises an end screw by which the volume of the gas plug can be changed.

19. The firearm of claim 17 said bolt carrier key has a dowel press fitted thereto, said dowel being configured to seat within an existing hole on said bolt carrier.

20. The firearm of claim 17 wherein said sleeve is machined or formed directly in said rod.

21. The firearm of claim 17 wherein said carrier key does not comprise a sleeve or depression to accept rod contact.

22. The firearm of claim 17 wherein the rod contacts the carrier at a flat surface.

23. The firearm of claim 17 wherein said biasing means is a compression coil spring, said rod being inserted into said compression coil spring, said coil spring being compressed between a delta ring and an annular shelf formed on an outer circumference of said rod.

24. The firearm of claim 17 wherein said first end of said rod is inserted into a cavity formed in said bolt carrier key.

25. The firearm of claim 17 wherein said direct drive retrofit system can be installed on said rifle without modification of said barrel and said bolt carrier.

26. The firearm of claim 17 wherein said gas block has a Picatinny rail formed thereon.

27. The firearm of claim 17 wherein said bolt carrier key has a dowel protrusion machined thereon, said dowel protrusion being configured to seat within an existing hole formed on said bolt carrier.

28. The firearm of claim 17 further comprising a compression-spring-loaded bolt which does not bear gas rings.

29. The firearm of claim 17 wherein said securing means comprises:

at least one key, said key being formed on an outer surface of said gas plug;

a keyway, said keyway being formed within said gas plug bore, said keyway being configured to receive said key;

a detent, said detent being spring loaded, said detent being located on said gas plug, a detent notch being located in a corresponding position within said gas plug bore;

wherein said key is aligned with said keyway, said gas plug is inserted into said gas plug bore, said spring loaded ball nesting at least partially within said detent notch.

30. A method for removing a system comprising the steps:

a) providing the system of claim 6;

b) extracting said gas plug from said gas block in a muzzleward direction;

c) decoupling said piston-cylinder coupling formed between said gas plug and said rod, a piston formed on said gas plug being slid out of a cylinder being formed on said rod upon extraction; and, d) removing said rod in a singular piece, said rod being free to be lifted away from said gas block, said rod being decoupled from said bolt carrier key without requiring access to said bolt carrier key.

31. A method for removing a system comprising the steps:

a) providing the system of claim 7;

b) extracting said gas plug from said gas block in a muzzleward direction;

c) decoupling said piston-cylinder coupling formed between said gas plug and said rod, a piston formed on said gas plug being slid out of a cylinder being formed on said rod upon extraction; and, d) removing said rod in a singular piece, said rod being free to be lifted away from said gas block, said rod being decoupled from said bolt carrier key without requiring access to said bolt carrier key.

* * * * *